United States Patent [19]

Lay

[11] Patent Number: 4,681,318

[45] Date of Patent: Jul. 21, 1987

[54] BALL HITTING PRACTICE DEVICE

[75] Inventor: William C. Lay, St. George, Utah

[73] Assignee: Grand Slam, Inc., Midvale, Utah

[21] Appl. No.: 875,065

[22] Filed: Jun. 17, 1986

[51] Int. Cl.[4] ..... A63B 69/36

[52] U.S. Cl. ..... 273/26 R; 272/78

[58] Field of Search ..... 273/26 E, 29 A, 26 R, 273/33, 202, 203, 204, 207, 208, 209, 211, 212, 197 A, 184 R, 184 B; 272/78

[56] References Cited

U.S. PATENT DOCUMENTS

| | | | |
|---|---|---|---|
| 925,342 | 6/1909 | Johnson | 272/78 |
| 1,890,696 | 12/1932 | Rosenhahn | 272/78 |
| 2,009,040 | 7/1935 | Beach | 272/78 |
| 2,082,272 | 6/1937 | Zinnow | 272/78 |
| 3,183,000 | 5/1965 | Dix | 273/26 R |
| 3,883,138 | 5/1975 | Chorey | 273/26 R |
| 4,227,691 | 10/1980 | Lefeber et al. | 273/26 R |
| 4,383,686 | 5/1983 | Cardieri | 273/26 R |

*Primary Examiner*—Richard C. Pinkham
*Assistant Examiner*—T. Brown

[57] ABSTRACT

A new type of baseball and softball hitting practice device which is easily adjusted for use in training young ball players comprising a planar base to which is attached a vertical pedestal, the pedestal having a first vertical resilient member having a ball fixedly attached to the terminal end and having the other end adapted to fitting into the end of a second resilient tubular member in telescopic manner, the bottom end of the second tubular member being fixedly attached to a coil spring which in turn is attached to a pivoting element which permits the pedestal to be inclined to the side, back or front depending on the desired position of the ball and then locked in that position.

8 Claims, 1 Drawing Figure

BALL HITTING PRACTICE DEVICE

BACKGROUND OF THE INVENTION

1. Field of the Invention

This invention relates to a new practice batting or hitting device. More particularly, the invention relates to a baseball or softball practice hitting device that avoids the necessity of retrieving the ball after the practice swing.

Specifically, the invention provides a new type of baseball and softball practice hitting device that is easily adjusted for use in training young ball players and which avoids the necessity of retrieving the ball after the practice swing. The new practice hitting device broadly comprises in combination a planar base adapted to being fixedly attached to a solid surface, such as the ground, a vertical pedestal fixedly attached to said base, said pedestal comprising a first vertical resilient round member having a ball fixedly attached to the terminal end and having the other end adapted to fitting into the end of a second resilient tubular member in telescopic manner so as to permit the first rounded member to be adjusted up and down, locking means to secure the first round member in the desired position, an elongated coil spring fixedly attached to the end of the second resilient tubular member adapted to permitting the entire vertical pedestal to bend forward when the ball is hit, pivoting means fixedly attached to the bottom end of the coil spring and to the surface of the planar base, said pivoting means being adapted to permitting the vertical pedestal to be inclined to the sides, front or back and then locked in the desired position.

2. Prior Art

In the game of baseball, one of the most difficult skills to master is hitting. First, a hitter must be able to coordinate the swing of a bat with the location of a ball so that good contact with the ball can be made while swinging the bat. Once this is mastered, the hitter must next learn to make good contact with the ball at the various positions at which it may cross home plate, from an inside pitch to an outside pitch, and from a high pitch to a low pitch, and various combinations of these two variables.

In development of these skills, the trainer or coach uses a baseball tee to support a ball at a selected height above a representation of the baseball home plate. The player then hits the ball out to the field, the ball is retrieved and placed on the tee for another swing. In this manner, the player can practice swinging and improve the coordination of his hands and eyes and develop his wrist and arm muscles.

Various practice batting tees have been developed in the past for this purpose. The practice tees developed to date, however, have had various limitations which have discouraged their overall acceptance in the baseball world.

In most cases, the ball is positioned on the tee and hit out into the field. This requires someone to retrieve the ball for the next hit. This has become very tiring work and discouraging to some players. In other cases, the tees have not been adjustable and different tees must be used for different hitting zones. In other cases the tees have been partially adjustable, but not able to cover all the hitting zones. In some cases, the tees have been adjustable, but the adjustment has required considerable time and manipulation to obtain a tee in the desired position. In other cases, the tees have been very expensive to produce, and the cost has been prohibitive for many of the smaller teams.

Following are examples of the prior art which disclose many of the tees having the above-noted limitations. U.S. Pat. Nos. 4,383,686, 4,277,691, 4,516,771, 2,862,712, 4,508,340, 3,877,695, 2,616,692 and 3,489,411.

The following patents disclose practice hitting devices wherein the ball is attached to a string and can be hit again when the string stops swinging or is retrieved: U.S. Pat. Nos. 4,050,694, 3,885,790, 3,716,235, 3,623,725. U.S. Pat. No. 3,794,320 discloses a device wherein the ball is attached to an arm which rotates 90 degrees, but is unable to be adjusted to various types of pitches.

It is an object of the invention, therefore, to provide a new practice hitting device for baseball and softball which corrects many of the above-described limitations. It is a further object to provide a practice hitting device which avoids the necessity of retrieving the ball after being hit. It is a further object to provide an adjustable practice hitting device which is adjustable and can be set for any hitting zone that a batter would experience in a normal game. It is a further object to provide a hitting device that can be easily and quickly adjusted to a new hitting position. It is a further object to provide a new adjustable hitting device which can be produced at low cost and can be made available to all softball and baseball teams. These and other objects of the invention will be apparent from the following detailed description thereof.

SUMMARY OF THE INVENTION

It has now been discovered that these and other objects may be accomplished by the new adjustable practice hitting device of the present invention which presents for the first time an efficient and economical way for the training of young batters in all aspects of the hitting techniques.

The new practice hitting device of the present invention broadly comprises in combination a planar base adapted to being fixedly attached to a solid surface, such as the ground, a vertical pedestal fixedly attached to said base, said pedestal comprising a first vertical resilient round member having a ball fixedly attached to the terminal end and having the other end adapted to fitting into the end of a second resilient tubular member in telescopic manner so as to permit the first round member to be adjusted up and down, locking means to secure the first round member in the desired position, an elongated coil spring fixedly attached to the end of the second resilient member adapted to permitting the entire vertical pedistal to bend forward when the ball is hit, pivoting means fixedly attached to the bottom end of the coil spring andto the surface of the planar base, said pivoting means being adapted to permitting the vertical pedestal to be inclined to the sides, front or back, and then locked in the desired position for the selected strike zone.

It has been surprisingly found that the new practice batting device described above solves many of the defects noted for the prior art devices. The new practice batting device, for example, avoids the necessity of retrieving the ball after the practice swing as the ball is firmly attached to the pedestal. After the ball has been hit, the pedestal bends forward and then quickly recovers its original position as a result of the coil spring at the base of the pedestal. Furthermore, the new device is easily adjusted to the desired height for the individual batter by lowering or raising the first resilient round member. In addition, the pedestal can be adjusted for the various types of pitches, such as inside, outside balls, by adjustment of the pivoting means at the base of the pedestal. The new devices are also inexpensive to produce and can be made available at low cost to all coaches and trainers involved in training young ball players.

DESCRIPTION OF THE DRAWING

The various objects and features of the present invention will be more fully understood by reference to the accompanying drawing. The drawing shows a perspective view of the pedestal mounted on the base plate. With reference to the drawing, the base plate having the conventional base size is shown as 10, with the apertures or holes for placing of stakes to secure the plate to the ground shown as 11. The pedestal firmly fixed to the base plate is shown as 12. The vertical member holding the ball 13 is shown as 14. The ball 13 is firmly attached to the vertical member by any suitable means, such as by adhesive, tape, screws, etc. In some cases, the vertical member 14 can be eliminated and the ball firmly attached to the first resilient tubular member 15. Tubular member 15 fits inside of the second resilient tubular member 16 and is held at the desired height by locking means 17. The base of the second resilient tubular member 16 is fixedly attached to the top of coil spring 19 which in turn is fixedly attached at the bottom of the spring to the top of pivoting means 18. By means of 18, the pedestal can be moved to the right or left, front or back and locked in the desired position by means of locking means 21. The pivoting means is fixedly attached to the base plate by means of a bolt from underneath 20.

DETAILED DESCRIPTION OF THE INVENTION

Figure 1:
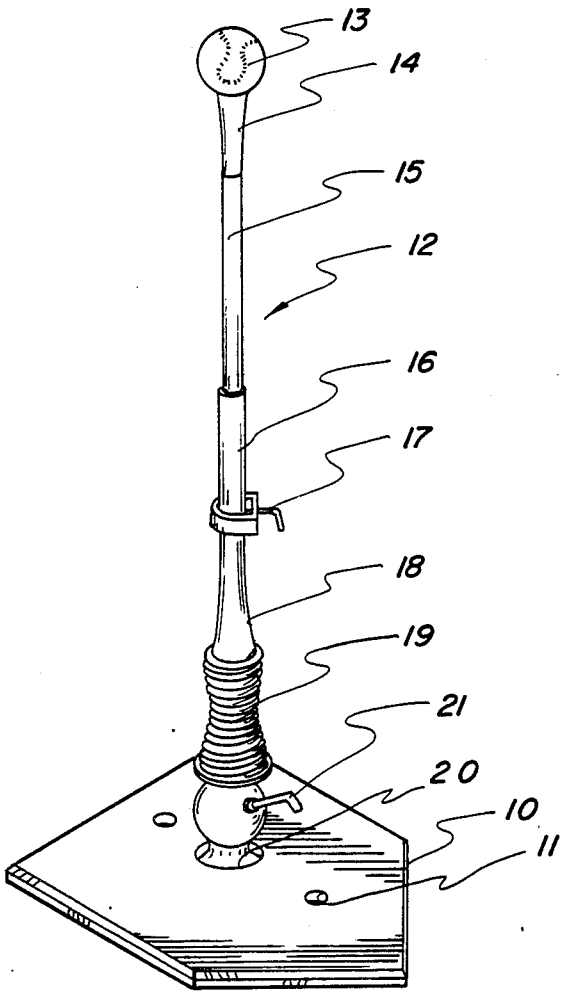

While the above-described description of the invention and drawing has been made in rather specific terms, it should be understood that various changes can be made in construction and operation without departing from the scope of the invention.

The planar base for the hitting device may be of any desired shape or size, and of any suitable material as long as it provides the base for the attachment of the upright pedestal. In general, the base is of the conventional baseball shape and is made from strong rubber. The conventional shape of the baseball plate 17″×17″ is preferably white so it can be easily seen.

As noted, the planar plate should be secured to a solid surface so that the pedestal can swing back after been hit. The plate may be secured to such a surface, as the ground, by any suitable means. Preferably the plate is secured by the insertion of several long pin through holes in the plate as shown by 11 in the drawing. One preferably employs at least two and generally from 2 to 4 such pins to hold the plate on the desired surface. Such pins are preferably prepared from metal, such as iron or steel.

As shown above, the all for which training is desired is fixedly attached to the top of the first resilient member. The balls employed may be of any suitable type, such as the general practice baseball or a plastic molded baseball or softball, a Whiffle ball, or it may be a regular baseball or softball which has been attached by adhesive, screws, tape, or the like to the first vertical member of the pedistal.

As shown in the drawing, the desired ball is fixedly attached to the top of vertical upright 14. This upright is preferably made of rubber or a highly flexible material so that in the even the hitter misses the ball and hits the pedestal it may absorb the hit without destroying the pedestal. This 14 is preferably a solid rubber member of about $\frac{1}{2}$ to $\frac{3}{4}$ inches in diameter and having a length of about 3 to 6 inches. As noted this member may be eliminated, if desired, and the ball attached directly to the first resilient member.

The first resilient round member 15 shown in the drawing may be a solid rod or tubular member adapted to fitting into the inside of tubular member 16. The member 15 may be prepared from any suitable material, but again is preferably prepared as a solid fiber glass rod ranging in general from about $\frac{1}{2}$ inch to 1 inch in diameter. The length of this first resilient round member may vary as desired, but generally will be from about 6 to 10 inches.

The second resilient tubular member 16 is a round tubular member adapted to having the first resilient member slip down inside in telescopic manner. This resilient member may also be prepared from any suitable material, such as fiber glass, plastic, oak wood, and the like, but is preferably prepared as a fiber glass tubular pipe. The diameter of the resilient member 16 should be sufficient for 15 to fit inside, and is thus preferably from $\frac{3}{4}$ to $1\frac{1}{4}$ inches in diameter. The length of this member 16 may vary over a wide range as desired, but generally wil be from about 6 to 10 inches.

The locking means used to secure the first resilient vertical member at the proper height may be of any suitable type. It is preferably a threaded lock bolt placed in a sleeve over the second resilient member and threaded into a hole in the said second resilient member such that when threaded in through the hole the bolt presses against the first resilient member and holds it in place. Other locking means, however, may be employed as desired or necessary.

A coil spring is fixedly attached to the bottom of the second resilient member. The spring is preferably prepared from iron or steel and made from tightly wound metal wire of preferably about $\frac{1}{8}$ to $\frac{3}{8}$ inch in diameter. The length of the coil may vary over a wide range as desired, but is preferably about 3 to 6 inches in length. The coil should obviously be of such strength that it can rapidly bring the pedestal back to its original place after the ball has been hit.

The bottom of the said coil spring is attached to a pivoting means, such as a metal ball joint, which allows the pedistal to be moved or pivoted inward, outward, front or back as desired to obtain the desired location of the ball. A locking means, such as the above-described lock bolt is utilized to keep the pedistal in the right position after it has been moved.

The device of the present invention may be utilized in a variety of different ways depending on the need for instruction in batting practice. As indicated, the device can be used for batting practice for baseball or for softball or for any other games involving the hitting of a ball with a bat or racket.

For hitting balls of average height one would preferably use a device as shown with the pedestal being about 29 inches to 49 inches high. In the event practice for hitting low balls is needed, one may lower the height of the pedestal to about 14 to 29 inches.

In the event practice is needed for hitting outside balls the pedestal can be pivoted so that it is leaning to the outside, and for the hitting of inside balls, the pedestal can be pivoted so that it is leaning inwardly.

The device is operated by placing the plate on the ground or other solid surface and securing it to the same. The desired ball is then securely fixed to the top of the first vertical member of the pedestal as described above, and the batter takes his position and swings at the ball. On contact, the pedestal is bent forward, but then rapidly recovers its original position because of the coil spring at the base of the pedestal.

PREFERRED EMBODIMENT OF THE INVENTION

A preferred embodiment of the invention is described below. It should be understood, however, that this is given as a preferred assembly of apparatus for certain training schedules and is not to be regarded as limiting the invention in any way.

The preferred apparatus was prepared as follows: A base plate 17"×25" was prepared from a sheet of hard rubber. A conventional ball joint of about 3"×3" was bolted to the middle of the plate and a lock bolt and sleeve placed thereover so as to secure the upright pedestal in the desired position. A heavy duty coil spring of about 6 inches in length with threaded metal ends was then attached to the top of the ball joint. The top end of the coil spring wal threaded to engage with the bottom of the second resilient tubular member. This tubular member was a fiber glass tube of about 1 inch in diameter and having a length of about 10 inches. The bottom had a bolt molded in said end so as to screw into the top of the coil spring. A small fiber glass tube of about 8 inches in length was placed inside the second resilient tubular member and secured therein by a lock bolt which was threaded through an outside sleeve and into a threaded hole in the top of the second resilient tubular member. A plastic molded baseball was attached by use of a plastic mold to the top ofthe first resilient fiber glass tube. Such an apparatus was used numerous times with a short period as the usual time for retrieving the ball and placing it on the tee had now been eliminated.

I claim as my invention:

1. An adjustable ball hitting practice device comprising in combination;

a. a planar base adapted to being secured to a solid surface, and b. a vertical pedestal fixedly attached to the top surface of said bse, said pedestal comprising a first vertically extending resilient member having a ball fixedly attached to one end thereof and having its other end fitting into the upper end of a second vertically extending resilient tubular member in telescopic manner so as to permit said first resilient member to be adjusted up and down, locking means to secure said first resilient member in a desired position, an elongated coil spring having one of its ends fixedly attached to the bottom end of said second resilient member permiting the entire vertical pedestal to bend when the ball is hit, pivoting means fixedly attached to the other end of the coil spring and to the surface of the planar base, said pivoting means permitting said vertical pedestal to be inclined to the side, front or back and then fixedly located in a desired position by locking means.

2. An adjustable ball hitting practice device as in claim 1 wherein the planar base possesses several holes to permitting stakes to be placed therein to secure the plate to a solid surface.

3. An adjustable ball hitting practice device as in claim 1 wherein the first and second resilient members are prepared from fiber glass.

4. An adjustable ball hitting practice device as in claim 1 wherein the base and coil spring are prepared from metal.

5. An adjustable ball hitting practice device as in claim 1 wherein the ball attached to the first resilient member is a plastic molded baseball.

6. An adjustable ball hitting practice device as in claim 1 wherein the ball is attached to an elongated rubber member which in turn is attached to the first resilient member.

7. An adjustable ball hitting practice device as in claim 1 wherein the ball is a softball.

8. An adjustable ball hitting practice device as in claim wherein the base plate is prepared from hard rubber sheet.

* * * * *